US006142362A

United States Patent [19]

Maus et al.

[11] Patent Number: 6,142,362

[45] Date of Patent: Nov. 7, 2000

[54] SHEET METAL LAYERS OF A LAYER-LIKE CONFIGURATION WITH ROLLED-ON BRAZING MATERIAL AND PROCESS FOR THE PRODUCTION OF A HONEYCOMB BODY THEREFROM

[75] Inventors: Wolfgang Maus, Bergisch Gladbach; Hans Bode, Remscheid; Ludwig Wieres, Overath, all of Germany

[73] Assignee: Emitec Gesellschaft fuer Emissionstechnologie mbH, Lohmar, Germany

[21] Appl. No.: 09/028,233

[22] Filed: Feb. 23, 1998

[30] Foreign Application Priority Data

Aug. 22, 1995 [DE] Germany ..... 195 30 835

[51] Int. Cl.[7] ..... B23K 31/02; B23K 101/02

[52] U.S. Cl. ..... 228/181; 228/208; 228/246; 228/262.42

[58] Field of Search ..... 228/181, 183, 228/208, 246, 262.42

[56] References Cited

U.S. PATENT DOCUMENTS

| | | | |
|---|---|---|---|
| 4,079,157 | 3/1978 | Yagi et al. | 148/531 |
| 4,381,590 | 5/1983 | Nonnenmann et al. | 29/890 |
| 4,602,001 | 7/1986 | Cyron | 502/439 |
| 4,686,155 | 8/1987 | Kilbane et al. | 428/653 |
| 5,110,690 | 5/1992 | Usui et al. | 428/678 |
| 5,366,139 | 11/1994 | Jha et al. . | |

FOREIGN PATENT DOCUMENTS

| | | |
|---|---|---|
| 0 159 468A2 | 4/1984 | European Pat. Off. . |
| 0 263 324 A1 | 4/1988 | European Pat. Off. . |
| 0 590 171 A1 | 4/1994 | European Pat. Off. . |
| 0 653 264 A1 | 5/1995 | European Pat. Off. . |
| 29 24 592 | 1/1981 | Germany . |
| 89/07488 | 8/1989 | WIPO . |

*Primary Examiner*—Samuel M. Heinrich
*Attorney, Agent, or Firm*—Herbert L. Lerner; Laurence A. Greenberg; Werner H. Stemer

[57] ABSTRACT

A sheet metal layer of a layer-like configuration with rolled-on brazing material and a process for producing a honeycomb body by stacking and/or winding sheet metal layers made of a layered material. At least a part of sheet metal layers for honeycomb bodies have a structure forming channels through which a fluid can flow. At least part of the sheet metal layers is formed initially of a layered material with at least one layer of chromium-containing steel and at least one mainly aluminum-containing layer, that are homogenized to a large extent during a subsequent heat treatment. The layered material is provided with at least one additional layer made of brazing material when it is produced by rolling, so that during a subsequent heat treatment at least parts of contact locations between the sheet metal layers are joined by brazing. The brazing material is preferably located only in a partial area of a bonding layer of the layered material, preferably in the form of brazing strips that extend along at least one edge.

12 Claims, 2 Drawing Sheets

SHEET METAL LAYERS OF A LAYER-LIKE CONFIGURATION WITH ROLLED-ON BRAZING MATERIAL AND PROCESS FOR THE PRODUCTION OF A HONEYCOMB BODY THEREFROM

CROSS-REFERENCE TO RELATED APPLICATION

This application is a national stage of International application Ser. No. PCT/EP96/03675, filed Aug. 21, 1996, which designated the United States.

BACKGROUND OF THE INVENTION

Field of the Invention

The invention relates to a process for the production of a honeycomb body in which sheet metal layers at least partially having a structure for forming passages through which a fluid can flow are stacked and/or wound. In particular the invention also relates to sheet metal layers with an outer aluminum layer for producing such honeycomb bodies, which are used in particular in exhaust gas systems of motor vehicles.

A honeycomb body of the above-indicated kind is known, for example, from International Publication WO 89/07488, corresponding to U.S. Pat. No. 5,102,743. The honeycomb body serves as a carrier for a catalyst which promotes the conversion of components of an exhaust gas, in particular an exhaust gas from an internal combustion engine, into compounds which are less environmentally polluting. Such honeycomb bodies are exposed to high levels of mechanical and thermal loading. Besides the mechanical and thermal loadings the sheet metal layers are exposed to an atmosphere which promotes corrosion. It is therefore desirable to use sheet metal layers which have a high degree of resistance to corrosion, for producing a honeycomb body.

U.S. Pat. No. 5,366,139 discloses using sheet metal layers which firstly are formed of a layered or laminate material, for producing honeycomb bodies. Such sheet metal layers have at least one layer of chromium-containing steel and at least one substantially aluminum-containing layer. A sheet metal layer of that kind is subjected to a heat treatment, in which the sheet metal layer is substantially homogenized. The expression "homogenization of the sheet metal layer" is used to denote diffusion of the aluminum into the steel so that the result is essentially a single-sheet, sheet metal layer of steel with aluminum.

German Published, Non-Prosecuted Patent Application 29 24 592 discloses various processes for applying brazing material to such sheet metal layers or honeycomb bodies produced therefrom. All such processes require a considerable level of expenditure, resources and additional production steps.

SUMMARY OF THE INVENTION

It is accordingly an object of the invention to provide a sheet metal layer of a layer-like configuration with rolled-on brazing material and a process for the production of a honeycomb body therefrom, which overcome the hereinafore-mentioned disadvantages of the heretofore-known products and processes of this general type, in which the process has as few production steps as possible but nonetheless results in a corrosion-resistant honeycomb body that can withstand mechanical loadings and in which the sheet metal layer is formed of composite material for the production of such bodies.

With the foregoing and other objects in view there is provided, in accordance with the invention, a process for the production of a honeycomb body, which comprises forming at least a portion of sheet metal layers by initially rolling-together layered material having at least one layer of chromium-containing steel and at least one substantially aluminum-containing layer while rolling solid brazing material onto at least one outer layer of the layered material during the production thereof; stacking and/or winding the at least partially structured sheet metal layers forming contact locations and passages through which a fluid can flow; and substantially homogenizing the layers in a later heat treatment to produce brazed joins at least at parts of the contact locations between the sheet metal layers and/or at contact locations between the sheet metal layers and a tubular casing. With the objects of the invention in view there is also provided a sheet metal layer, comprising a rolled-together layered material having at least one layer of chromium-containing steel and at least one substantially aluminum-containing layer, at least one of the layers being an outer layer; and brazing material rolled onto the at least one outer layer of the layered material forming a composite surface, preferably in such a way that the composite surface is substantially free from raised portions.

In the production of a sheet metal layer according to the invention, during the step of rolling together the load-containing metal layers, the brazing material which is required for making the later outer connection is also simultaneously rolled onto the same. That eliminates expensive production steps which are concerned with subsequently applying and fixing brazing material. The honeycomb body only needs to be wound or layered and can then be passed to the brazing process. Applying brazing material in a rolling procedure in which various layers are in any case rolled together is much less expensive than subsequently applying brazing material to the sheet metal layers or honeycomb body.

Various ways of applying brazing material and various kinds of configurations of brazed joins and connections of a honeycomb body are known from the state of the art.

In accordance with another mode of the invention, placing the brazing material on the surface of the sheet metal layers in a strip-wise manner makes it possible to achieve almost all desired configurations with respect to the later brazed joins. Strips which are between 2 and 10 mm and in particular about 5 mm in width are preferred. Depending on the type of structure involved the strips can be disposed on one or both sides and on one or both edges. It is in particular also possible to provide only half of the sheet metal layers for a honeycomb body, in particular smooth sheet metal layers, with layers of brazing material, while the other sheet metal layers are produced without brazing material.

In accordance with a further mode of the invention, in the event of the particularly advantageous use of nickel-based brazing material for the brazing material strips, they can be applied in the common rolling procedure with the step of rolling on aluminum layers, in which case the relatively harder nickel material is pressed into the aluminum layer so that a surface which is almost free from raised portions is produced, in spite of the strips. In that operation brazing foils or films or also brazing material wire or brazing powder which is scattered onto the surface can be used. When wire of brazing material is used, depending on the choice of the brazing material, the roll configuration and the way in which the procedure is implemented, the wire of brazing material may be only slightly pressed flat or shaped into wide strips, in the rolling-in operation.

Conventionally applied layers of brazing material with, for example, a local thickness of more than 10 $\mu$ result under some circumstances in mechanical instability of a honeycomb body since the brazing material flows in the brazing operation and in that way honeycomb bodies which have been previously put under stress can suffer from stress relief.

In contrast, in accordance with an added mode of the invention, the thickness of the brazing material in the finished rolled sheet metal layer only needs to be, for example, between about 0.5 and 3 $\mu$.

Due to the reduction in the number of steps of the process, the present invention makes it possible to arrive at a less expensive production of the sheet metal layers provided with brazing material and in particular an inexpensive production of wide sheet metal layer strips. The sheet metal layer strips which are required for honeycomb bodies under some circumstances are cut therefrom, in different widths. Thus, when rolling in the brazing material, consideration is to be given to a suitable spacing with respect to the strips of brazing material, in order to avoid excessive waste.

By virtue of the way in which the process is implemented and due to the use of a layered material which has at least one layer of chromium-containing steel and at least one substantially aluminum-containing layer, the brazing material can be a nickel-based brazing material, with the maximum brazing temperature being between 1100 and 1150° C.

In accordance with an additional mode of the invention, the brazing material contains between 0.5 and 8% boron, in particular between 3 and 6% boron. Boron in the brazing material serves as a diffusion accelerator so that this affords a reduction in the amount of time required for the brazing procedure, with equivalent brazing compounds. A reduction in the period of time required for the brazing procedure has the result of ensuring that it is possible to achieve higher through-put rates through a brazing furnace. The high aluminum content which can be achieved with respect to the homogenized sheet metal layers makes it possible to compensate for disadvantageous properties of the boron component in terms of corrosion resistance of the layered or laminate material.

In accordance with yet another mode of the invention, the heat treatment is firstly effected in a temperature range in which the brazing material does not yet melt. After extensive homogenization of the sheet metal layers the temperature is raised to the melting temperature of the brazing material. That operating procedure has the advantage of ensuring that substantial homogenization of the sheet metal layers is achieved and then a durable brazed connection is produced.

Other features which are considered as characteristic for the invention are set forth in the appended claims.

Although the invention is illustrated and described herein as embodied in sheet metal layers of a layer-like configuration with rolled-on brazing material and a process for the production of a honeycomb body therefrom, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
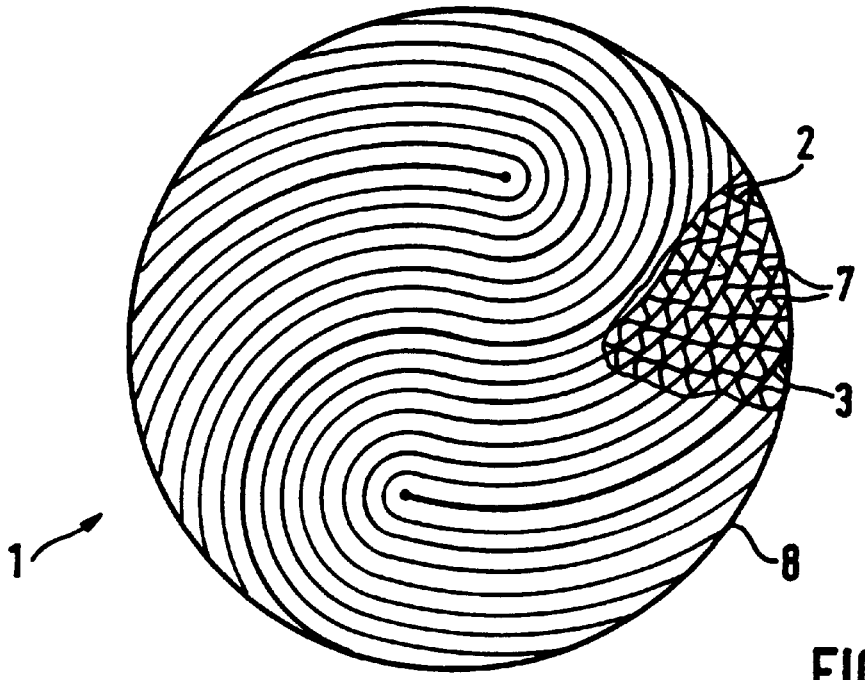
FIG.1 PRIOR ART
FIG. 1 is a diagrammatic, cross-sectional view of a honeycomb body in accordance with the prior art.

Referring now to the figures of the drawings in detail and first, particularly, to FIG. 1 thereof, there is seen a honeycomb body 1. The honeycomb body 1 includes stacked and wound sheet metal layers which are resistant to high-temperature corrosion. The honeycomb body 1 is made from alternate smooth and corrugated sheet metal layers 2, 3. The smooth and the corrugated layers 2, 3 are of a layered or laminate configuration. It is, however, also possible for a honeycomb body to be produced partially from homogenous sheet metal layers and partially from layered material. In the case of a layered material 10, respective layers 5, 6 which essentially are formed of aluminum, are applied to both sides of an inner layer 4, as can be seen from FIG. 2. The layered material 10 in FIG. 2, like the layered material 11, 12 in FIGS. 3 and 4, is shown with an appearance as it looks prior to heat treatment.

The honeycomb body 1 has a structure for forming passages 7 through which a fluid can flow and its sheet metal layers are disposed in a tubular casing 8. The tubular casing 8 preferably has a layer which essentially is formed of aluminum on its inner surface, at least in partial regions thereof. It can, however, also be connected to the sheet metal layers alone or in addition through the use of conventional brazing procedures. It is also possible to produce a honeycomb body without using a prefabricated tubular casing, for example by a procedure whereby a smooth sheet metal layer is wound around a structure being formed of stacked and wound sheet metal layers and is brazed to itself.

Figure 2:
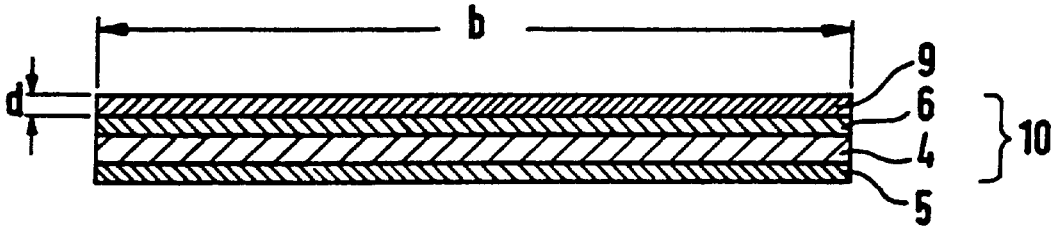
FIG. 2 is a sectional view of a sheet metal layer formed of a layered or laminate material with a layer of brazing material.
Figure 3:
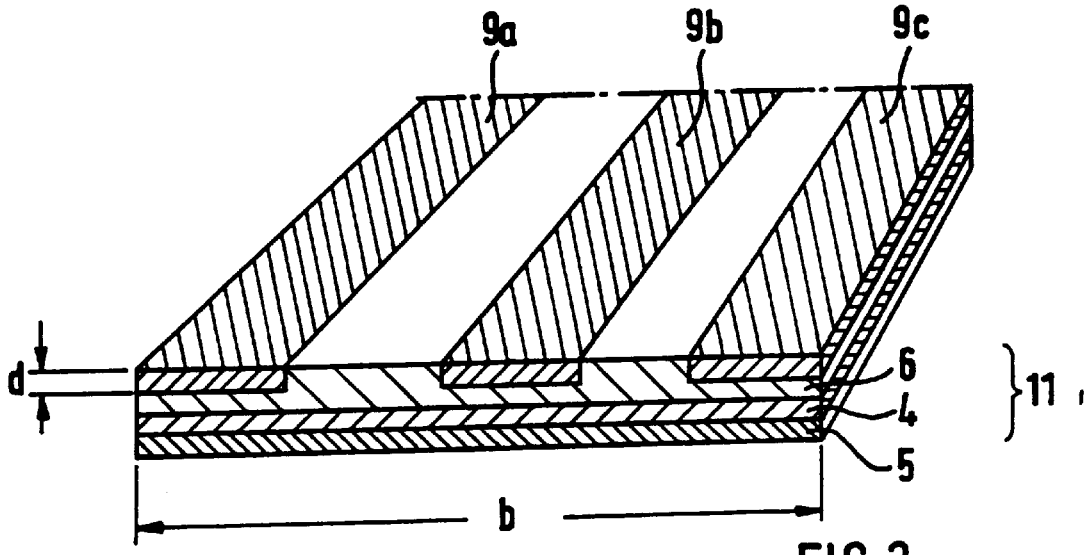
FIG. 3 is a sectional, perspective view of a sheet metal layer formed of a layered or laminate material with a plurality of strips of brazing material rolled therein.
Figure 4:
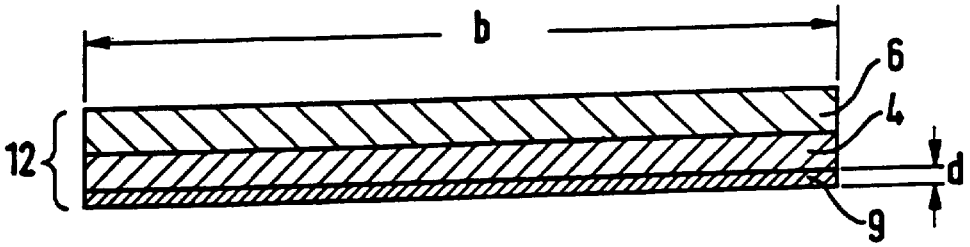
FIG. 4 is a sectional view of a sheet metal layer formed of a layered or laminate material with three layers, of which one is a layer of brazing material.

FIG. 2, FIG. 3 and FIG. 4 show various embodiments of sheet metal layers according to the invention. However, these embodiments are only examples. Depending on the location, number and size of the desired brazed connections, layers, strips or other patterns of brazing material can be rolled onto the outside of one or both sides of the layered material. It is also possible for brazing material to be rolled into the interior of a layered material. That can be advantageous, for example, when wire of brazing material is firstly to be partially rolled flat. Thereafter a layer which is of softer material than the brazing material can then be rolled on, so that the brazing material is pressed through that layer until it reaches the surface of the layered material. In the embodiments of FIGS. 2 and 3, brazing material 9 and 9*a*, 9*b*, 9*c* is rolled exclusively onto the aluminum layers 5, 6. Unlike the embodiment of FIGS. 2 and 3, the brazing material 9 or 9*a*, 9*b*, 9*c* can also be rolled on the outside onto a metal layer of another material, for example as shown in FIG. 4, in which it is rolled onto an outwardly disposed chromium-containing steel layer.

As FIG. 3 shows, in many cases it is desirable for the brazing material to be placed only in strips 9*a*, 9*b*, 9*c* at partial regions of the composite surface produced by the rolling-on operation. That can be the case on one or both sides of the sheet metal layers. A preferred construction has strips 9*a*, 9*c* at least at one edge region of the sheet metal layers which later result in brazed connections at the ends in the honeycomb body to be produced, since the sheet metal layers are of a width b which corresponds to the subsequent axial length of the honeycomb body 1. Unlike the situation with the embodiments shown in FIGS. 2 and 3, with a brazing material layer or with brazing material strips having a thickness d which is independent of location, the brazing material may also be of a thickness which is dependent on location. For example, such constructions can be produced by rolling wire or powder of brazing material onto the layer.

The process according to the invention can be used for honeycomb bodies which are formed entirely or partially of sheet metal layers that are of a laminate-like configuration and it inexpensively results in bodies which can carry a mechanical loading, are resistant to high-temperature corrosion and are particularly suitable for exhaust gas catalytic converters of motor vehicles.

We claim:

1. A process for the production of a honeycomb body, which comprises:

forming at least a portion of sheet metal layers by initially rolling layered material having at least one layer of chromium-containing steel and at least one substantially aluminum-containing layer while rolling solid brazing material onto at least one outer layer of the layered material;

at least one of stacking and winding the at least partially structured sheet metal layers forming contact locations and passages through which a fluid can flow; and substantially homogenizing the layers in a heat treatment to produce brazed joins by initially carrying out the heat treatment in a temperature range in which the aluminum diffuses into the steel but the brazing material does not yet melt, and raising the temperature to a brazing temperature only after extensive homogenization of the layered material.

2. The process according to claim 1, which comprises producing the brazed joins at least at parts of the contact locations between the sheet metal layers.

3. The process according to claim 1, which comprises producing the brazed joins at contact locations between the sheet metal layers and a tubular casing.

4. The process according to claim 1, which comprises producing the brazed joins at least at parts of the contact locations between the sheet metal layers and at contact locations between the sheet metal layers and a tubular casing.

5. The process according to claim 1, which comprises placing the brazing material only at a part of a composite surface of the layered material in the rolling-on step.

6. The process according to claim 5, which comprises placing the brazing material in the form of a strip of brazing material at least at one edge region.

7. The process according to claim 1, which comprises rolling the brazing material onto both outer layers of the layered material.

8. The process according to claim 1, which comprises selecting a nickel-based alloy as the brazing material.

9. The process according to claim 8, which comprises selecting a brazing material containing between 0.5 and 8% boron.

10. The process according to claim 8, which comprises selecting a brazing material containing between about 3 and 6% boron.

11. The process according to claim 1, which comprises selecting a width of the sheet metal layers corresponding to an axial length of a honeycomb body to be produced, and placing a strip of the brazing material with a strip width of between 2 and 10 mm at least at one edge region subsequently forming an end of the honeycomb body.

12. The process according to claim 11, which comprises selecting the strip width to be about 5 mm.

* * * * *